US006066422A

United States Patent [19]

Blaszak et al.

[11] Patent Number: 6,066,422

[45] Date of Patent: May 23, 2000

[54] COLOR TONER COMPOSITIONS AND PROCESSES THEREOF

[75] Inventors: Sue E. Blaszak, Penfield; Edul N. Dalal, Webster; Kristen M. Natale-Hoffman, Rochester; Elliott A. Eklund, Penfield; Paul C. Julien, Webster, all of N.Y.

[73] Assignee: Xerox Corporation, Stamford, Conn.

[21] Appl. No.: 09/178,172

[22] Filed: Oct. 23, 1998

[51] Int. Cl.[7] ..... G03G 13/01; G03G 9/09

[52] U.S. Cl. ..... 430/45; 430/106; 430/137

[58] Field of Search ..... 430/45, 106, 137

[56] References Cited

U.S. PATENT DOCUMENTS

| | | | |
|---|---|---|---|
| 5,204,208 | 4/1993 | Paine et al. | 430/137 |
| 5,391,456 | 2/1995 | Patel et al. | 430/137 |
| 5,557,393 | 9/1996 | Goodman et al. | 430/105 R |
| 5,688,626 | 11/1997 | Patel et al. | 430/137 |
| 5,713,062 | 1/1998 | Goodman et al. | 399/49 |
| 5,837,409 | 11/1998 | Bertrand et al. | 430/45 |
| 5,866,286 | 2/1999 | Christy et al. | 430/45 |
| 5,866,288 | 2/1999 | Ciccarelli et al. | 430/106 |
| 5,885,739 | 3/1999 | Dalal et al. | 430/106 |

*Primary Examiner*—Roland Martin
*Attorney, Agent, or Firm*—John L. Haack

[57] ABSTRACT

A process including:

blending toners from a set of primary toners to form a set of secondary toners; and developing the secondary color toners to form spot color images, wherein the color gamut of all said images embody substantially the entire PANTONE® spot color space.

19 Claims, No Drawings

COLOR TONER COMPOSITIONS AND PROCESSES THEREOF

REFERENCE TO COPENDING AND ISSUED PATENTS

Attention is directed to commonly owned and assigned U.S. Pat. No. 5,723,245, to Bertrand et al., issued Mar. 3, 1998, entitled "Colored Toner and Developer Compositions and Process for Enlarged Color Gamut", which patent discloses a combination of toners including a cyan toner, a magenta toner, a yellow toner, an orange toner, a green toner and a black toner, each of the toners containing resin and pigment wherein the pigment for the orange toner can be Orange 5, C.I. number 12075, and the pigment for the green toner can be Green 7, C.I. number 74260, and wherein the pigment for each of the toners excluding black can be prepared by flushing processes; and U.S. Pat. No. 5,712,068, to Dalal, et al., issued Jan. 27, 1998, which patent discloses toners comprised of a cyan toner, a magenta toner, a yellow toner, a green toner, and a black toner, each of the toners being comprised of resin and pigment; and wherein the pigment for the green toner is Green 7, CI Number 74260, or Green 36, CI Number 74265, and wherein the pigment, excluding black, is dispersed in the resin by flushing, wherein a cyan, magenta, green, and yellow pigment water wet cake is mixed with toner resin, and the water is substantially removed to generate pigmented resin.

Attention is directed to commonly owned and assigned copending application U.S. Ser. No. 08/178,147, filed Oct. 23, 1998, entitled "Color Liquid Developers And Processes Thereof"; and U.S. Ser. No. 09/178,158, filed Oct. 23, 1998, entitled "Color Toner Compositions and Processes Thereof".

The disclosures of each the above mentioned patents and copending applications are incorporated herein by reference in their entirety. The appropriate components and processes of these patents may be selected for the toners and processes of the present invention in embodiments thereof.

BACKGROUND OF THE INVENTION

The present invention is generally directed to toner compositions and processes thereof. More specifically, the present invention is directed to toner compositions and processes for forming an extended gamut of custom colors by dry blending a mixture of selected color toners, and thereafter developing the mixed toner particles to form color images which embody substantially all the PANTONE® colors.

In embodiments of the present invention there are provided high quality custom color gamut processes wherein the color gamut refers to a range of colors that an imaging system can generate. One way of quantifying the color gamut is in terms of the number of PANTONE® colors that the imaging device can produce. For example, there are 1,000 standard PANTONE® colors used in the graphic arts and about half of them can be produced by a typical four-color printing process, and the remainder are outside of its color gamut. The process of the present invention in embodiments thereof involves the use of two or more toners from a selected primary set of twelve toners to achieve custom colors not otherwise attainable without the specific toner combinations disclosed and illustrated herein. The present process can produce substantially all of the image colors that are contained in the PANTONE® color space, of about 972 colors.

The process of the present invention in embodiments thereof involves the use of one or more, that is mixtures, of dry developer colors, such as orange, red, purple, violet, blue, green, and transparent white, that is an unpigmented or clear resin liquid toner, in addition to cyan, magenta, yellow, and black process colors to achieve substantially complete PANTONE® color gamut expansion. The present invention provides substantially complete color gamut expansion or access using mixtures of a comparatively small number of custom color inks, for example, from about 9 to about 12 colors, and can achieve from about 85 to about 100 percent of the known PANTONE® color space, and which color gamut can be achieved with a color difference of developed images, or $\Delta E$, of from about 0.1 to about 5.0 CIELAB units compared to a target color. The compositions and processes of the present invention are useful in many electrostatographic applications, for example, in xerographic printers and copiers, and the like xerographic marking devices.

By blending any one or more of the primary set of twelve toners in a specified formulation, virtually all of the PANTONE® colors can be matched. The primary set of toners includes but is not limited to a black toner made from Carbon Black such as Regal 330 or similar pigment, a transparent or colorless white toner made in accordance with the other toners with the exception that it contains no pigment or is pigment free, a yellow toner made with PY 17 or similar pigment, an orange toner made from PO 34 or similar pigment, a magenta toner made with PR 81:2 or similar pigment, a purple toner made with PV 1 or similar pigment, a violet toner made with PV 23 or similar pigment, a blue toner made from PB 61 or similar pigment, a cyan toner made from PB 15:3 or similar pigment, and a green toner made from PG 7 or similar pigment, a red toner made from PR 57:1 or similar pigment, and a red toner made from PR 53:1 or similar pigment.

In embodiments, the yellow toner pigment can be, for example, Pigment Yellow 17 such as Paliotol Yellow from BASF, the orange toner pigment can be, for example, Pigment Orange 34 such as Irgalite Orange F2G from Ciba Geigy, the red toner pigments can be, for example Pigment Red 53:1 such as Lithol Red from BASF and Pigment Red 57:1 such as Lithol Rubine from BASF, the magenta toner pigment can be, for example, Pigment Red 81:2 such as Fanal Pink D4830 from BASF, the purple toner pigment can be, for example, Pigment Violet 1 such as Fanal Violet from BASF, the violet toner pigment can be, for example, Pigment Violet 23 such as Sunfast Violet 23 from Sun Chemical, the blue toner pigment can be, for example, Pigment Blue 61 such as Alkali Blue from BASF, the cyan toner pigment can be, for example, Pigment Blue 15:3 such as Heliogen Blue from BASF, the green toner pigment can be, for example, Pigment Green 7 such as Sunfast Green 7 from Sun Chemical, the black toner pigment can be, for example, carbon black, such as REGAL 330 carbon black from Cabot, and the colorless toner or clear white toner is pigment free. It is readily apparent to one of ordinary skill in the art that the aforementioned pigments can include pigments that are similar to or equivalents thereof.

The compositions and processes of the present invention are useful in many electrostatographic applications, for example, in xerographic printers and copiers, include high quality color applications.

PRIOR ART

U.S. Pat. No. 5,713,062, to Goodman et al., issued Jan. 27, 1998, which patent discloses a system and method for color mixing control in an electrostatographic printing system. An operative mixture of colored developing material is continuously replenished with selectively variable amounts of developing materials of basic color components making up the operative mixture. The rate of replenishment of various color components added to the operative mixture is controlled to provide a mixture of developing material capable of producing a customer selectable color on an output copy substrate. A colorimeter is provided for monitoring the color of a test image printed with the operative mixture of developing material in the supply reservoir so that the color thereof can be brought into agreement with a color required to produce the customer selectable output color. The present invention can be used to control and maintain the color of the operational mixture of developing material in the reservoir through continuous monitoring and correction in order to maintain a specified ratio of color components in the reservoir over extended periods associated with very long print runs. The present invention may also be utilized to mix a customer selectable color in situ, whereby approximate amounts of primary color components are initially deposited and mixed in the developing material reservoir and resultant images printed with the developing material mixture are continually monitored and adjusted until the mixture reaches a desired color output.

U.S. Pat. No. 5,557,393, to Goodman et al., issued Sep. 17, 1996, which patent discloses a process and apparatus for achieving customer selectable colors in an electrostatographic imaging system which includes forming an electrostatic latent image on an image forming device, developing the electrostatic latent image on the image forming device with at least one developer containing carrier particles and a blend of two or more compatible toner compositions, and transferring the toner image to a receiving substrate and fixing it thereto. Among the compatible toner compositions that may be selected are toner compositions having blend compatibility components coated on an external surface of the toner particles and particulate toner compositions containing therein blend compatibility components or passivated pigments. Electrostatographic imaging devices, including a tri-level imaging device and a hybrid scavengeless development imaging device, are also provided for carrying out the described process. The processes and apparatus of the present invention are especially useful in imaging processes for producing single color or highlight color images using customer selectable colors, or for adding highlight color to a process color image produced by the same apparatus.

U.S. Pat. No. 5,688,626, to Patel, et al., issued Nov. 18, 1997, and which patent discloses a gamut toner aggregation processes including a process for the preparation of a combination of color toners comprised of a cyan toner, a magenta toner, a yellow toner, and a black toner, each of the toners being comprised of resin and pigment, and wherein the pigment is cyan, magenta, yellow and black, each of the pigments are dispersed in a nonionic, or neutral charge surfactant, and wherein each toner in the combination is prepared by (i) preparing a pigment dispersion, which dispersion is comprised of a pigment and nonionic water soluble surfactant; (ii) shearing the pigment dispersion with a latex or emulsion blend comprised of resin, a counterionic surfactant with a charge polarity of opposite sign to that of the ionic surfactant and a nonionic surfactant; (iii) heating the above sheared blend below about the glass transition temperature (Tg) of the resin to form electrostatically bound toner size aggregates; and (iv) heating the bound toner size aggregates above about the Tg of the resin.

U.S. Pat. No. 5,391,456, to Patel, et al., issued Feb. 21, 1995, which patent discloses a process for the preparation of toner compositions comprising: (i) forming a dispersion of resin in an aqueous ionic surfactant solution; (ii) preparing pigment dispersions in water of three different pigments each of a dissimilar color, each dispersion being comprised of a pigment dispersed in water and which preparation utilizes nonionic dispersants, and optionally an ionic surfactant; (iii) blending the prepared resin dispersed as a latex with two, or optionally three of the different color pigment dispersions of step (ii); (iv) adding an aqueous solution of counterionic surfactant as a coagulant to the formed resin-pigment blends, while continuously subjecting the mixture to high shear, to induce a homogeneous gel of the flocculated resin-pigments blend; (v) heating the above sheared gel at temperatures between about 20° C. and about 5° C. below the glass transition temperature (Tg) of the resin while continuously stirring at speeds between about 200 and about 500 revolutions per minute to form statically bound toner sized aggregates between about 2 and about 12 microns in average volume diameter with a narrow size dispersity and with a geometric size distribution (GSD) between 1.10 and 1.25; (vi) heating the statically bound aggregated particles at temperatures of from between 25° C. and 40° C. above the Tg of the resin to form coalesced rigid particles of a toner composition comprised of polymeric resin, and pigment agent; and optionally (vii) separating and drying the toner.

U.S. Pat. No. 5,204,208, to Paine et al., issued Apr. 20, 1993, which patent discloses a process for obtaining custom color toner compositions which comprises admixing at least two encapsulated toners wherein each toner is comprised of a core comprised of a polymer binder, pigment, dye, or mixtures thereof, and a polymeric shell; and wherein the pigment, dye, or mixtures thereof is different for each toner, thereby resulting in a toner with a color different than each of the encapsulated toners.

The aforementioned references are incorporated in their entirety by reference herein.

SUMMARY OF THE INVENTION

Embodiments of the present invention, include:

A process comprising:

blending dry toners to form a blended colored toner; and developing the blended colored toner to form spot color images, wherein the color gamut of all the images encompasses substantially all of the PANTONE® color space;

A process comprising:

blending toners from a set of from 9 to 12 primary toners in amounts of from bout 0.1 to about 99.9 weight percent based on the total weight of blended toners to form a set of secondary toners;

developing the secondary color toners to form color images, wherein the color characteristics of the color images embody from about 91 to about 100 percent of the PANTONE® spot color space; and Colored toner compositions comprising: a blend of first or primary colored toners wherein each toner is comprised of a resin; a pigment selected from a set of about 8 to about 12 pigments; and optionally a charge control agent or flow aid; and An imaging process comprising:

developing electrostatographic latent images with custom blended toners comprised of up to about 9 primary colored toners, and thereafter transferring and fixing the developed color images to a receiver member, and wherein the color characteristics of the resulting developed color images encompass from about 91 to about 100 percent of the PANTONE® color space.

These and other embodiments of the present invention are illustrated herein.

DETAILED DESCRIPTION OF THE INVENTION

The present invention provides, in embodiments:

Colored toner compositions toners comprising: a blend of at least two primary colored toners wherein each toner is comprised of a resin; a pigment selected from a set of about 8 to about 11 pigments; and optionally a charge control agent or flow aid;

Processes for preparing spot color toners and developers comprising:

blending two or more dry toners to form a blended colored toner; and developing the blended colored toner to form a color image, wherein the color characteristics of the resulting developed color images encompasses substantially all of the PANTONE® color space;

An imaging process comprising:

developing electrostatographic latent images with custom blended toners comprised of up to about 9 primary colored toners, and thereafter transferring and fixing the developed color images to a receiver member, and wherein the color characteristics of the resulting developed color images encompass from about 91 to about 100 percent of the PANTONE® color space.

Toners and toners blends of the present invention can be prepared, for example, by conventional melt blending followed by comminution and classification or by emulsion aggregation or other in situ methodology.

The present invention provides a number of advantages and improvements as illustrated herein, including overcoming or minimizing deficiencies of prior art toner compositions and processes, by providing a carefully chosen set of either a reduced set of nine primary toners or an expanded set of twelve primary toners which toners all contain well dispersed colorants such as selected colored pigments, for example: a black toner made from carbon black such as Regal 330 or similar pigment; a transparent or clear white toner made in accordance with the other toners with the exception that it contains no pigment; a yellow toner made with Pigment Yellow 17 or similar pigment; an orange toner made from Pigment Orange 34 or similar pigment; a magenta toner made with Pigment Red 81:2 or similar pigment; a purple toner made with Pigment Violet 1 or similar pigment; a violet toner made with Pigment Violet 23 or similar pigment; a blue toner made from Pigment Blue 61 or similar pigment; a cyan toner made from Pigment Blue 15:3 or similar pigment; and a green toner made from Pigment Green 7 or similar pigment; a red toner made from Pigment Red 57:1 or similar pigment; and a toner made from Pigment Red 53:1 or similar pigment, which color toners can match virtually all of the PANTONE® colors when one or more of the toners are mixed according to a specified formulations which are prescribed by a color mixing model. These toners may be preblended using any conventional blending technique such as barrel tumbling, cone mixing, high intensity blade mixing, and the like methods. The toners may also be blended in situ, for example, in a development fixture such as a fluidized bed for ion charging apparatus or a turbo-magnetically agitated zone enhanced developer housing.

Table 1 provides a listing of 11 primary pigments that can be selected for preparing the aforementioned expanded 12 primary toner set. The preferred 8 primary pigments that can be selected for preparing the aforementioned reduced 9 primary toner set comprises the 11 primary pigments of Table 1 but without PR 53:1, PR 57:1, and PV 23.

TABLE 1

11 Primary Pigments Selected for 12 Primary Toners.

| Pigment | Type - Description | CI Number |
|---|---|---|
| PY 17 | Yellow - Diarylide Yellow | 21105 |
| PO 34 | Orange - Diarylide Orange | 21115 |
| PR 53:1 | Red - Monoazo:barium salt of 2-naphthol acid | 15585:1 |
| PR 57:1 | Red - Monoazo:calcium salt of 2-naphthol acid | 15850:1 |
| PR 81:2 | Magenta - Xanthene:salt of Basic Dye | 45160:3 |
| PV 1 | Purple - Xanthene:salt of Basic Dye | 45170:2 |
| PV 23 | Violet - Oxazine | 51319 |
| PB 61 | Blue - Triphenylmethane:inner Salt | 42765:1 |
| PB 15:3 | Cyan - Copper Phthalocyanine | 74160 |
| PG 7 | Green - Chlorinated Copper Phthalocyanine | 74260 |
| PB 7 | Black - Regal 330 Carbon Black | 77266 |
| NONE | Colorless - pigment free | — |

The yellow pigment can be, for example, Pigment Yellow 17 such as Paliotol Yellow from BASF, the orange toner pigment can be, for example, Pigment Orange 34 such as Irgalite Orange F2G from Ciba Geigy, the red toner pigments are non-equivalent, that is dissimilar in color properties, and can be, for example, Pigment Red 53:1 such as Lithol Red from BASF and Pigment Red 57:1 such as Lithol Rubine from BASF, the magenta toner pigment can be, for example, Pigment Red 81:2 such as Fanal Pink D4830 from BASF, the purple toner pigment can be, for example, Pigment Violet 1 such as Fanal Violet from BASF, the violet toner pigment can be, for example, Pigment Violet 23 such as Sunfast Violet 23 from Sun Chemical, the blue toner pigment can be, for example, Pigment Blue 61 such as Alkali Blue from BASF, the cyan toner pigment can be, for example, Pigment Blue 15:3 such as HELIOGEN Blue from BASF, the green toner pigment can be, for example, Pigment Green 7 such as Sunfast Green 7 from Sun Chemical, the black toner pigment can be, for example, carbon black such as REGAL 330™ carbon black from Cabot, and the colorless toner is free of pigment. It is readily apparent to one of ordinary skill in the art that the aforementioned pigments can include pigments that are substantially similar or equivalents thereof in name or color properties.

The present invention is generally directed to processes for preparing custom color xerographic toners and developer compositions, and their application and use in color imaging. More specifically, the present invention is directed to developer and toner compositions containing certain economical pigments, and mixtures thereof, and wherein an expanded gamut of custom color developed images with excellent resolution can be obtained.

The present invention provides complete color gamut expansion or access using mixtures of a comparatively small number of custom color xerographic developers, for example, twelve (12) dry color toners, and wherein this toner set can achieve from about 91 to about 100 percent of the known PANTONE® color space within a color difference ($\Delta E^*$) of from about 0.1 to about 5 CIELAB units.

The set of xerographic toners can be readily prepared by blending together two or more of the primary 12 toner set, in specified amounts, to produce all 972 non-metallic and non-fluorescent PANTONE® colors with a $\Delta E^*$ of for example about 1.0 to about 3.0, and as illustrated herein.

$\Delta E^*$ is known in the art as a relative measure of color difference between two samples in the CIELAB color space.

In embodiments of the present invention, high quality dispersions of the pigments within the toner compositions is an important aspect and is believed to be directly related to the quality of the resulting color images. High quality pigment dispersion in the primary toner set can be achieved, for example, by flushing the pigment such as used in melt mixed or extruded toners, or by using pigment dispersing agents during processing, such as melt mixing or emulsion polymerization, of the resin in the presence of the pigment particles. In embodiments, the toners of the present invention contain flushed pigments, and wherein there is selected a wet pigment, or wet cake for each colored toner followed by heating to melt the resin to render it molten and shearing, and wherein water is removed or substantially removed from the pigment, and there is generated a polymer phase around the pigment enabling, for example, substantial, partial passivation of the pigment. A solvent can be added to the product obtained to provide a high quality dispersion of pigment and resin, and wherein the pigment is present in an amount of from about 25 to about 70, and preferably from about 30 to about 50 weight percent with respect to the weight of the resin component. Subsequently, the dispersed pigment in resin or wet cake product obtained is mixed and diluted with a toner resin, which resin can be similar, or dissimilar to the resin mixed with the wet pigment, to provide a toner comprised of resin and pigment, and wherein the pigment is present in an amount of from about 0.5 to about 40, and preferably from about 2 to about 20 weight percent based on the weight of the combined toner components of resin and pigment.

There is provided in accordance with the present invention toners with the colored pigment dispersed to a high quality state. With the present invention, there is enabled a combination of toners with a high color gamut, especially in reflection developed images and with transparencies, and wherein with transparencies a substantial amount of scattered light and embodiments most of the scattered light is eliminated allowing, for example, about 70 to about 98 percent of the transmitted light passing through a fused image on a transparency to reach the screen from an overhead projector. The toner and developer compositions of the present invention can be selected for electrophotographic, especially known xerographic, imaging and printing processes, and more especially, full color processes.

Of importance with respect to the present invention are the pigments, or mixtures of pigments selected for each toner, and the combined set of toners, such as the cyan toner, the magenta toner, the green toner, the yellow toner, an orange toner, a purple toner, a violet toner, two red toners, a blue toner, a transparent or clear white toner, and a black toner, and processes thereof as it is with these pigments and processes that there are enabled the advantages of the present invention illustrated herein and including excellent stable triboelectric characteristics, acceptable stable admix properties, superior color resolution, the capability of obtaining substantially any spot colors desired, that is a full color gamut, for example, thousands of different colors and different developed color images, toners that are not substantially adversely affected by environmental changes of temperature, humidity, and the like, the provision of separate toners, such as a cyan toner, a magenta toner, a green toner, a yellow toner, an orange toner, a purple toner, a violet toner, two red toners, a blue toner, a transparent white toner, and a black toner, and mixtures thereof, with the advantages illustrated herein, and which toners can be selected for spot and multicolor development of electrostatic images. The specific selection of colored toners together with exceptionally well dispersed pigments provides, for example, a smooth fused image surface and enables a large color gamut which assures that thousands of custom colors can be produced. The toner compositions of the present invention usually contain surface additives and may also contain charge additives, waxes, such as polypropylene, polyhydroxy compounds, or polymeric alcohols, such as the UNILINS®, available from Petrolite Chemicals, reference U.S. Pat. No. 4,883,736, the disclosure of which is totally incorporated herein by reference. The aforementioned alcohols are, in embodiments of the present invention, selected as components for dispersing the pigments.

"Set" refers, in embodiments of the present invention, to the twelve (12) primary toners which are prepared individually and are not, at least initially, mixed or blended with other toners. Rather, each toner exists as a separate and distinct composition and each toner is thereafter admixed or blended with one or more of the other color toners in the 12 primary color toner set and thereafter developed into custom color images. The PANTONE® color space accessible with the aforementioned 12 color toner set includes, for example, 791,000 CIELAB volume units including virtually all 972 nonmetallic and non-fluorescent PANTONE colors. The blending or admixing of the toners of the present invention can be accomplished during manufacture, or alternatively, in a developer housing just prior to image development, with or without a carrier component present, such as the Xerox Corporation Model 5775.

Toner and developer compositions are known, including toners with specific colored pigments, and their preparation, and are illustrated in U.S. Pat. No. 5,262,264, the disclosure of which is totally incorporated herein by reference.

Developer compositions with charge enhancing additives, which impart a positive charge to the toner resin, are also known. Thus, for example, there is described in U.S. Pat. No. 3,893,935 the use of quaternary ammonium salts as charge control agents for electrostatic toner compositions; U.S. Pat. No. 4,221,856 discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens, such as iodide, chloride and bromide; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Further, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Moreover, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other patents disclosing positively charged toner compositions with charge control additives include U.S. Pat. Nos. 3,944,493; 4,007,293; 4,079,014; 4,394,430 and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

There is illustrated in U.S. Pat. No. 4,404,271 a complex system for developing electrostatic images with a toner which contains a metal complex represented by the formula in column 2, for example, and wherein ME can be chromium, cobalt or iron. Additionally, other U.S. Patents disclosing various metal containing azo dyestuff structures wherein the metal is chromium or cobalt include U.S. Pat. Nos. 2,891,939; 2,871,233; 2,891,938; 2,933,489; 4,053,462 and 4,314,937. Also, in U.S. Pat. No. 4,433,040, the disclosure of which is totally incorporated herein by reference, there are illustrated toner compositions with chromium and cobalt complexes of azo dyes as negative charge enhancing additives. Further, of interest are U.S. Pat. Nos. 5,262,264 and 5,437,949, the disclosures of which are totally incorporated herein by reference.

U.S. Pat. Nos. 5,391,456 and 5,688,626, to Patel, disclose emulsion-aggregation methodologies for dispersing pigments in resin particles and for preparing toner particles thereby, which disclosures are incorporated by reference herein in their entirety. Also, U.S. Pat. No. 5,712,068 discloses methodologies for dispersing pigments in resin particles and for preparing toner particles thereby using conventional toner processing techniques and which disclosure is incorporated by reference herein in its entirety.

The ratios of the 12 primary toners selected for a given blended toner were determined using a color model based on Kubelka-Munk color theory.

The Kubelka-Munk color model is a mathematical model used to describe the reflectance of opaque samples. The model considers the absorption and scattering occurring in a colored sample of fixed thickness, and is applied on a wavelength by wavelength basis throughout the visible region of the electromagnetic spectrum. The reflectance of the sample at each wavelength depends on four factors: an absorption spectrum, K(λ), a scattering spectrum, S(λ), the sample thickness, X, and the reflectance spectrum of the substrate or backing, Rp(λ). The model considers the illuminating light to be collimated, and the light penetrating the sample is considered to be scattered. While the light can be scattered in any direction, the model considers two net fluxes: straight up and straight down.

Along with the material absorption spectrum, K(λ), and scattering spectrum, S(λ), the reflectance of a sample also depends on sample thickness, X, and the reflectance spectrum of the substrate or backing, Rp(λ). What is commonly referred to as the exponential form of the Kubelka-Munk equation is given in equation 1.

$$R = \frac{\frac{R_p - R_\infty}{R_\infty} - R_\infty\left(R_p - \frac{1}{R_\infty}\right)\exp\left[SX\left(\frac{1}{R_\infty} - R_\infty\right)\right]}{R_p - R_\infty - \left(R_p - \frac{1}{R_\infty}\right)\exp\left[SX\left(\frac{1}{R_\infty} - R_\infty\right)\right]} \quad (1)$$

The parameter $R_\infty$ represents the reflectance of an infinitely thick sample, and is directly related to the absorption and scattering properties of the colorant in the following manner:

$$R_\infty = 1 + \frac{K}{S} - \sqrt{\left(\frac{K}{S}\right)^2 + 2\left(\frac{K}{S}\right)} \quad (2)$$

The original Kubelka-Munk color model works well for single layer uniform images. The method used to model the reflectance of images made by blending one or more toners involves applying the weighted sum of the absorption and scattering spectra of the individual toners to the Kubelka-Munk color model. For example, a green color made by combining 40% Yellow and 60% Cyan toners would be modeled with the following absorption (K) and scattering (S) spectra:

$$K\ \text{green}\ (\lambda) = 0.40 * K\ \text{yellow}\ (\lambda) + 0.60 * K\ \text{cyan}\ (\lambda)$$

$$S\ \text{green}\ (\lambda) = 0.40 * S\ \text{yellow}\ (\lambda) + 0.60 * S\ \text{cyan}\ (\lambda)$$

The model may be used as a tool to aid in toner design. One specific application in which the color model is used in toner design involves determining the correct blending ratios of two or more color toners that are needed to achieve a specified target CIELAB value.

To match a target CIELAB color using a combination or blend of one or more toners, the K and S spectra of the individual toners need to be determined. Once these parameters are known, the reflectance spectrum, and therefore the CIELAB values, may be determined for any blending ratio of the primary toners using the Kubelka-Munk color model. The modeled color may then be compared to the target color, using a CIELAB ΔE* as a measure of the color difference. A loop or reiterative process of toner blending ratios of the primary toners may be stepped through until an acceptable color difference between the modeled and target CIELAB value is obtained.

The invention will further be illustrated in the following nonlimiting Examples, it being understood that these Examples are intended to be illustrative only and that the invention is not intended to be limited to the materials, conditions, process parameters, and the like, recited herein. Parts and percentages are by weight unless otherwise indicated. The toners in the examples were prepared and used at arbitrary toner masses. For the preparation of images in a printing machine the pigment concentrations are adjusted so that the target colors are achieved for machine-specific toner masses.

EXAMPLE I

Preparation of Cyan Toner A toner was prepared in accordance with U.S. Pat. No. 5,688,626, where the pigment selected is Pigment Blue 15:3 at a pigment loading of about 3.6 weight percent, and wherein the CIELAB values at a developed mass of 0.6 mg/cm$^2$ were L*=50.04, a*=−32.91, b*=−61.8.

EXAMPLE II

Preparation of Magenta Toner The procedure of Example I was repeated with the exception that the pigment selected was Pigment Red 81:2 at a pigment loading of approximately 4.7 weight percent, and wherein the CIELAB values at a developed mass of 0.4 mg/cm$^2$ were L*=53.74, a*=85.34, b*=−19.32.

EXAMPLE III

Preparation of Green Toner The procedure of Example I was repeated with the exception that the pigment selected was Pigment Green 7 at a pigment loading of approximately 2.0 weight percent, and wherein the CIELAB values at a developed mass of 4.0 mg/cm$^2$ were L*=51.92, a*=−90.4, b*=−4.48.

EXAMPLE IV

Preparation of Red Toner The procedure of Example I was repeated with the exception that the pigment selected was Pigment Red 53:1 at a pigment loading of approximately 2.0 weight percent, and wherein the CIELAB values at a developed mass of 1.2 mg/cm$^2$ were L*=62.28, a*=72.48, b*=65.2.

EXAMPLE V

Preparation of Orange Toner The procedure of Example I was repeated with the exception that the pigment selected was Pigment Orange 34 at a pigment loading of approximately 2.0 weight percent, and wherein the CIELAB values at a developed mass of 0.8 mg/cm$^2$ were L*=71.88, a*=55.84, b*=107.81.

EXAMPLE VI

Preparation of Purple Toner The procedure of Example I was repeated with the exception that the pigment selected was Pigment Violet 1 at a pigment loading of approximately 2.0 weight percent, and wherein the CIELAB values at a developed mass of 1.0 mg/cm$^2$ were L*=49.04, a*=57.16, b*=−44.84.

EXAMPLE VII

Preparation of Violet Toner The procedure of Example I was repeated with the exception that the pigment selected was Pigment Violet 23 at a pigment loading of approximately 2.0 weight percent, and wherein the CIELAB values at a developed mass of 0.6 mg/cm$^2$ were L*=27.81, a*=58.85, b*=−64.58.

EXAMPLE VIII

Preparation of Blue Toner The procedure of Example I was repeated with the exception that the pigment was Pigment Blue 61 at a pigment loading of approximately 2.0 weight percent, and wherein the CIELAB values at a developed mass of 1.2 mg/cm$^2$ were L*=21.82, a*=34.79, b*=−77.55.

EXAMPLE IX

Preparation of Red Toner The procedure of Example I was repeated with the exception that the pigment was Pigment Red 57:1 at a pigment loading of approximately 3.0 weight percent, and wherein the CIELAB values at a developed mass of 0.6 mg/cm$^2$ were L*=46.95, a*=82.94, b*=8.92.

EXAMPLE X

Preparation of Yellow Toner The procedure of Example I was repeated with the exception that the pigment was Pigment Yellow 17 at a pigment loading of approximately 5.0 weight percent, and wherein the CIELAB values at a developed mass of 0.6 mg/cm$^2$ were L*=94.69, a*=−7.94, b*=113.31.

EXAMPLE XI

Preparation of Black Toner The procedure of Example I was repeated with the exception that the pigment was Regal 330™ carbon black at a pigment loading of approximately 5.0 weight percent, and wherein the CIELAB values at a developed mass of 1.0 mg/cm$^2$ were L*=3.89, a*=−0.48, b*=−0.88.

EXAMPLE XII

Preparation of Transparent White Toner The procedure of Example I was repeated with the exception that the pigment was omitted, that is the toner is pigmentless pr without any pigment, and wherein the CIELAB values at a developed mass of 0.6 mg/cm$^2$ were L*=99.53, a*=−0.17, b*=0.39.

EXAMPLE XIII

Preparation of Blended Custom Color Orange Toner There is blended together three of the twelve primary toners as follows: blending 57 weight percent of the toner of Example IV, where the pigment is Pigment Red 53:1, and 35 weight percent of the toner of Example X, where the pigment is Pigment Yellow 17, and 8 weight percent of the toner of Example IX, where the pigment is Pigment Red 57:1. Blending of the primary toners is accomplished with, for example, simple mixing in a barrel mill, roll mill, jet mill, cone mixer, toner dispenser, developer housing, and combinations thereof, for a sufficient time to accomplish intimate mixing, for example, from 10 seconds to about 1 hour depending on, for example, the scale of equipment, the flowability properties of the primary toners, the number of primary toners in the blend, and the like considerations. The resulting blended orange toner matches PANTONE 1585 with a color difference of within about 0.7 ΔE* units.

EXAMPLE XIV

Preparation of Blended Custom Color Red Toner The procedure of Example XIII is repeated with the exception that a red toner is prepared by blending 70 weight percent of the toner of Example II containing Pigment Red 81:2, and 30 weight percent of the toner of Example X containing Pigment Yellow 17. The resulting blended toner matches PANTONE 184® with a color difference of within about 2 ΔE* units.

Accompanying Table 2 illustrates 34 exemplary PANTONE® coated colors, which formulas are based on a total toner mass of 1.5 mg/cm$^2$ and the appropriate ratios of toner from the primary set of colorants that may be blended to achieve the resulting colored toners. The accuracy of the color properties of the blend is characterized by a CIELAB ΔE* color difference value. The PANTONE® coated colors illustrated herein are modeled in the yellow-green-cyan region of CIELAB color space. It is readily apparent to one of ordinary skill in the art that the foregoing principles and processes are equally applicable to the blue and red regions of CIELAB color space.

Other modifications of the present invention may occur to one of ordinary skill in the art based upon a review of the present application and these modifications, including equivalents thereof, are intended to be included within the scope of the present invention.

TABLE 2

Exemplary PANTONE ® Coated Color Toner Blends.

| Pantone ID (coated) | Target Color (D50/02) L* | a* | b* | % Combined Inks: Cyan toner % | Yellow toner % | Green toner % | Clear toner % | Black toner % | Ink Color (D50/02) L* | a* | b* | Model v. Measured ΔE* (CIE-LAB) |
|---|---|---|---|---|---|---|---|---|---|---|---|---|
| 310 | 76.41 | −29.89 | −18.1 | 10.7 | 1.3 | 0.0 | 88.0 | 0.0 | 75.07 | −29.01 | −18.11 | 1.6 |
| 311 | 70.71 | −33.18 | −23.58 | 16.0 | 1.3 | 0.0 | 82.7 | 0.0 | 69.16 | −30.59 | −22.58 | 3.2 |
| 312 | 61.55 | −34.7 | −29.46 | 20.0 | 1.3 | 0.0 | 78.7 | 0.0 | 64.63 | −35.55 | −29.80 | 3.2 |
| 314 | 43.36 | −24.81 | −23.72 | 13.3 | 0.0 | 13.3 | 66.7 | 6.7 | 42.54 | −24.77 | −23.79 | 0.8 |
| 315 | 38.42 | −17.88 | −15.08 | 20.0 | 2.7 | 0.0 | 70.7 | 6.7 | 41.95 | −19.98 | −15.65 | 4.1 |
| 316 | 35.57 | −8.95 | −5.67 | 1.3 | 0.0 | 13.3 | 72.0 | 13.3 | 35.42 | −9.61 | −4.69 | 1.2 |
| 3105 | 78.23 | −30.76 | −14.07 | 1.3 | 0.0 | 13.3 | 72.0 | 13.3 | 78.73 | −29.69 | −13.11 | 1.5 |
| 3115 | 71.3 | −35.85 | −20.02 | 13.3 | 1.3 | 0.0 | 85.3 | 0.0 | 70.66 | −35.47 | −19.19 | 1.1 |
| 3125 | 64.89 | −38.08 | −22.98 | 16.0 | 1.3 | 0.0 | 82.7 | 0.0 | 67.23 | −39.45 | −22.70 | 2.7 |
| 3135 | 47.98 | −28.14 | −17.53 | 8.0 | 0.0 | 20.0 | 65.3 | 6.7 | 44.97 | −26.51 | −17.15 | 3.4 |
| 3145 | 43.22 | −21.41 | −13.01 | 13.3 | 1.3 | 0.0 | 78.7 | 6.7 | 44.30 | −21.92 | −13.32 | 1.2 |
| 317 | 87.27 | −19.8 | −2.01 | 0.0 | 0.0 | 0.0 | 100.0 | 0.0 | 89.06 | −18.28 | −0.29 | 2.9 |
| 318 | 80.11 | −31.24 | −9.55 | 6.7 | 0.0 | 0.0 | 93.3 | 0.0 | 78.61 | −30.05 | −11.94 | 3.1 |
| 319 | 71.7 | −39.97 | −14.45 | 10.7 | 1.3 | 0.0 | 88.0 | 0.0 | 72.22 | −40.42 | −14.66 | 0.7 |
| 321 | 48.84 | −34.73 | −14.18 | 0.0 | 0.0 | 46.7 | 46.7 | 6.7 | 46.70 | −34.24 | −11.84 | 3.2 |
| 322 | 44.55 | −24.6 | −9.62 | 8.0 | 0.0 | 13.3 | 72.0 | 6.7 | 45.81 | −25.36 | −10.54 | 1.7 |
| 324 | 81.29 | −26.44 | −4.15 | 8.0 | 1.3 | 0.0 | 90.7 | 0.0 | 79.09 | −24.29 | −3.47 | 3.2 |
| 325 | 70.1 | −38.07 | −7.18 | 9.3 | 1.3 | 0.0 | 89.3 | 0.0 | 73.64 | −39.69 | −7.14 | 3.9 |
| 330 | 41.1 | −11.3 | −2.23 | 2.7 | 0.0 | 26.7 | 64.0 | 6.7 | 47.76 | −29.42 | −5.44 | 2.1 |
| 3252 | 75.2 | −42.92 | −6.89 | 0.0 | 0.0 | 26.7 | 60.0 | 13.3 | 37.96 | −10.75 | −1.44 | 3.3 |
| 3262 | 68.2 | −48.87 | −8.18 | 4.0 | 1.3 | 6.7 | 88.0 | 0.0 | 81.55 | −37.01 | −4.84 | 1.7 |
| 3272 | 59.09 | −51.1 | −8.55 | 4.0 | 0.0 | 13.3 | 82.7 | 0.0 | 77.88 | −45.02 | −7.01 | 3.4 |
| 3282 | 50.78 | −34.46 | −5.97 | 13.3 | 2.7 | 0.0 | 84.0 | 0.0 | 68.10 | −48.51 | −8.12 | 0.4 |
| 3292 | 41.92 | −18.18 | −2.96 | 24.0 | 6.7 | 0.0 | 69.3 | 0.0 | 60.32 | −53.78 | −8.72 | 3.0 |
| 3302 | 37.92 | −11.16 | −1.83 | 0.0 | 0.0 | 53.3 | 40.0 | 6.7 | 49.98 | −34.95 | −4.75 | 1.5 |
| 3255 | 74.9 | −47.14 | −3.09 | 0.0 | 0.0 | 26.7 | 60.0 | 13.3 | 37.96 | −10.75 | −1.44 | 0.6 |
| 3265 | 68.53 | −52.79 | −3.59 | 4.0 | 1.3 | 6.7 | 88.0 | 0.0 | 81.17 | −37.76 | −1.74 | 1.8 |
| 3275 | 59.68 | −54.23 | −3.72 | 8.0 | 1.3 | 6.7 | 84.0 | 0.0 | 73.18 | −46.62 | −3.92 | 2.0 |
| 3285 | 55.17 | −37.26 | −2.26 | 8.0 | 1.3 | 13.3 | 77.3 | 0.0 | 71.00 | −54.00 | −3.59 | 2.7 |
| 3295 | 50.58 | −28.48 | −1.7 | 22.7 | 6.7 | 0.0 | 70.7 | 0.0 | 61.17 | −53.02 | −4.71 | 2.2 |
| 3248 | 77.67 | −32.13 | 0.61 | 0.0 | 0.0 | 33.3 | 60.0 | 6.7 | 51.26 | −27.87 | −1.34 | 1.0 |
| 3258 | 69.8 | −40.27 | 0.83 | 0.0 | 0.0 | 26.7 | 60.0 | 13.3 | 37.82 | −11.15 | −0.03 | 3.3 |
| 3268 | 62.43 | −43.89 | 1.54 | 0.0 | 0.0 | 0.0 | 100.0 | 0.0 | 79.29 | −34.88 | −1.91 | 4.1 |
| 3278 | 55.24 | −44.02 | 1.47 | 9.3 | 2.7 | 0.0 | 88.0 | 0.0 | 73.47 | −42.58 | 0.59 | 4.3 |

What is claimed is:

1. A process comprising:

modeling a target spot color with a set of primary toners;

blending toners selected from the set of primary toners that match the target spot color to form a set of secondary toners; and developing said secondary color toners to form spot color images, wherein the color gamut of all said images embody substantially the entire spot color space used in printing, wherein the set of primary toners comprises 9 toners prepared from a set of 8 pigments consisting of: a yellow pigment, an orange pigment, a magenta pigment, a purple pigment, a blue pigment, a cyan pigment, a green pigment, and a black pigment; and a thermoplastic resin, and a pigment free colorless toner.

2. A process in accordance with claim 1, wherein the set of primary toners comprises 12 toners prepared from a set of 11 pigments further consisting of: two non-equivalent red pigments, and a violet pigment.

3. A process in accordance with claim 2, wherein there is blended together of from 2 to about 9 primary toners to form a secondary color dry toner.

4. A process in accordance with claim 1, wherein there is blended together of from 2 to about 4 primary toners to form a secondary color dry toner.

5. A process in accordance with claim 1, wherein the color gamut of all accessible spot colors comprises 747,000 CIELAB volume units including from about 92 to about 97 percent of the 972 nonmetallic and non-fluorescent colors with a ΔE* of from about 0.1 to about 5.

6. A process in accordance with claim 2, wherein the color gamut of all accessible spot colors comprises 791,000 CIELAB volume units including from about 96 to about 98 percent of the 972 nonmetallic and non-fluorescent colors with a ΔE* of from about 0.1 to about 5.

7. A process in accordance with claim 2, wherein the yellow pigment is Pigment Yellow 17, the orange toner pigment is Pigment Orange, the red toner pigments are Pigment Red 53:1 and Pigment Red 57:1, the magenta toner pigment is Pigment Red 81:2, the purple toner pigment is Pigment Violet 1, the violet toner pigment is Pigment Violet 23, the blue toner pigment is Pigment Blue 61, the cyan toner pigment is Pigment Blue 15:3, the green toner pigment is Pigment Green 7, the black toner pigment is carbon black, and the colorless toner is free of pigment.

8. A process in accordance with claim 1, wherein the blending of the primary toners is accomplished with a barrel mill, roll mill, jet mill, cone mixer, toner dispenser, developer housing, and combinations thereof.

9. A process in accordance with claim 1, wherein developing said secondary toners is accomplished in an imaging apparatus selected from the group consisting of a two component electrostatographic development system, a hybrid scavengeless developer system, a single component development system, a turbo-magnetically agitated zone enhanced developer system, an ion charging development system, a liquid developer system, and combinations thereof.

10. A process in accordance with claim 1, wherein the colored primary toners are colored and are comprised of a resin, at least one pigment, and optionally a charge control agent and optionally a flow aid.

11. A process comprising:

modeling a target spot color with a set of dry primary toners;

blending the modeled dry toners to form a blended colored toner; and developing said blended colored toner to form spot color images, wherein the color gamut of all said spot color images encompasses from about 91 to about 100 percent of the spot color space.

12. A process in accordance with claim 11, wherein said blending is accomplished: in a developer housing; prior to introduction into a developer housing; or just prior to developing said image.

13. Colored toner compositions comprising:

a modeled blend of first colored toners each comprised of a resin in an amount of from about 60 to about 99 weight percent of the total weight of the toner; a pigment in an amount of from about 1 to about 40 weight percent of the total weight of the toner selected from 8 pigments consisting of: a yellow pigment, an orange pigment, a magenta pigment, a purple pigment, a blue pigment, a cyan pigment, a green pigment, and a black pigment, and a pigment free colorless toner; and optionally a charge control agent or flow aid in an amount of about 0.5 to about 5.0 weight percent of the total, wherein the color characteristics of the color images embody substantially all the entire spot color space used in printing, wherein the pigments are selected from the group consisting of Pigment Yellow 17, Pigment Orange 34, Pigment Red 81:2, Pigment Violet 1, Pigment Violet 23, Pigment Blue 61, Pigment Blue 15:3, Pigment Green 7, and carbon black.

14. A composition in accordance with claim 13, wherein the pigments can further comprise two non-equivalent red pigments Pigment Red 53:1 and Pigment Red 57:1, and a violet pigment Pigment Violet 23.

15. A composition in accordance with claim 14, wherein the spot color space comprises 791,000 CIELAB volume units including from about 96 to about 98 percent of the 972 nonmetallic and non-fluorescent spot colors.

16. An imaging process comprising:

developing electrostatographic latent images with modeled blended toners comprised of from 2 to about 9 primary colored toners and a pigment free colorless toner, and thereafter transferring and fixing the developed color images to a receiver member, and wherein the color characteristics of the resulting developed color images encompass from about 91 to about 100 percent of the PANTONE® color space.

17. A printing machine comprising: a developer housing and a latent image receiving member adapted for developing modeled mixtures of a set of primary toners to form spot color images, and wherein the color gamut of the spot color images encompasses substantially the entire spot color space used in printing.

18. The process in accordance with claim 1, wherein the primary toners are present in amounts of from about 0.1 to about 99.9 weight percent based on the total weight of blended secondary toners.

19. A process in accordance with claim 1, wherein modeling includes:

i) approximating the target spot color with one or more primary toners with known or determined K and S values;

ii) determining the reflectance(R) and L*a*b* values for the resulting primary toner combination;

iii) comparing the respective L*a*b* values of the target spot color and combined primary toners, wherein the color difference therebetween is $\Delta E^*$; and iv) repeating steps i.) through iii.) until $\Delta E^*$ is from about 0.1 to about 5.0.

* * * * *